US005822643A

United States Patent [19]

Rosenburgh et al.

[11] Patent Number: 5,822,643

[45] Date of Patent: Oct. 13, 1998

[54] PHOTOGRAPHIC PROCESSOR

[75] Inventors: John H. Rosenburgh, Hilton; Ralph L. Piccinino, Jr., Rush, both of N.Y.

[73] Assignee: Eastman Kodak Company, Rochester, N.Y.

[21] Appl. No.: 839,283

[22] Filed: Apr. 17, 1997

[51] Int. Cl.[6] ..... G03D 3/02

[52] U.S. Cl. ..... 396/626; 396/627; 396/636

[58] Field of Search ..... 396/626, 627, 396/636, 641

[56] References Cited

U.S. PATENT DOCUMENTS

| | | | |
|---|---|---|---|
| 3,177,793 | 4/1965 | Stewart | 396/574 |
| 5,032,871 | 7/1991 | Murata et al. | 396/617 |
| 5,270,762 | 12/1993 | Rosenburgh et al. | 396/636 |
| 5,313,243 | 5/1994 | Rosenburgh et al. | 396/626 |
| 5,335,039 | 8/1994 | Muller et al. | 396/627 |
| 5,353,087 | 10/1994 | Rosenburgh et al. | 396/636 |
| 5,353,088 | 10/1994 | Rosenburgh et al. | 396/626 |
| 5,355,190 | 10/1994 | Rosenburgh et al. | 396/627 |
| 5,381,203 | 1/1995 | Piccinino, Jr. et al. | 396/627 |
| 5,386,261 | 1/1995 | Patton et al. | 396/620 |
| 5,398,094 | 3/1995 | Rosenburgh et al. | 396/626 |
| 5,400,106 | 3/1995 | Rosenburgh et al. | 396/636 |
| 5,418,591 | 5/1995 | Rosenburgh et al. | 396/627 |
| 5,420,659 | 5/1995 | Manico et al. | 396/619 |

*Primary Examiner*—D. Rutledge
*Attorney, Agent, or Firm*—Frank Pincelli

[57] ABSTRACT

An apparatus for processing a photosensitive material. The apparatus has a narrow processing channel for containing a processing solution for processing a photographic material. The processing channel has an inlet and an outlet. An entrance fluid retention area is provided adjacent the inlet and an exit fluid retention area is provided adjacent the outlet. A fluid balancing channel is provided which extends between said entrance fluid retention area and said exit fluid retention area.

21 Claims, 7 Drawing Sheets

PHOTOGRAPHIC PROCESSOR

FIELD OF THE INVENTION

The present invention relates to the field of photographic processors and, in particular, to low volume thin tank type processors.

BACKGROUND OF THE INVENTION

U.S. Pat. Nos. 5,270,762; 5,353,088; 5,400,106; 5,420,659; 5,313,243; 5,355,190; 5,398,094; 5,418,591; 5,347,327; 5,386,261; 5,381,203; 5,353,087 illustrate thin tank processors wherein a photosensitive material is passed through a narrow processing channel. A nozzle is often used for impinging a processing solution onto the photosensitive material as it passes through the processing channel. These type processors are also of the low volume type construction designed to minimize the amount of processing solution present in the processing section. As a result of this type construction, an entrance fluid retention area is formed at the inlet of the processing channel and an exit fluid retention area is formed at the outlet end of the processing channel. The level of the processing solution in these two retention areas is substantially maintained by fluid passing through the processing channel.

While these type processors have provided efficient processing of photosensitive material while using a relatively small amount of processing solution, Applicants have found that in certain situations an undesirable surface wave of processing solution is created in the processing channel. An initial wave occurs just prior to the photosensitive material reaching the nozzle which momentarily blocks the entrance area of the narrow processing channel. This causes the processing solution to rise in the area of the channel ahead of the photosensitive material. As the solution rises, it either overflows into the next processing section, or out of the overflow level control weir.

When the trailing edge of the photosensitive material passes the impingement nozzle, the opposite action occurs in that the photosensitive material now blocks the processing channel ahead of the nozzle, causing the processing solution to rise in the area of the processing channel behind the trailing edge. This again results in processing solution overflowing out of the processing section, or overflow level control weir.

When the processing solution is being directed to one side of the processing channel, the level of the processing solution is being lowered on the other side. When the processing solution goes too low, vortexing of the processing solution at the tank outlet may occur as processing solution is continuously being removed from the processing tank. This vortexing can result in the processing section actually running dry in the processing channel. While one side of the processing channel is getting too much processing solution, the other side is getting too little, both of these conditions being detrimental to the processing apparatus.

It can be seen that when a narrow processing channel is used in combination with an impingement nozzle for introducing processed solution into the processing channel, inefficient use of the processing solution may result in that temporarily excess solution may overflow out of the processing section. Additionally, undesirable vortexing of the processing solution may occur.

The present invention solves the foregoing problems by providing a recirculation low fluid management channel to balance the surface level of the processing solution in the processing section, thereby allowing the processing solution to flow freely between the entrance side of the processing channel and the exit area of the processing channel, without having to travel through the narrow processing channel.

SUMMARY OF THE INVENTION

In accordance with the present invention there is provided an apparatus for processing a photosensitive material. The apparatus has a narrow processing channel for containing a processing solution for processing a photographic material. The processing channel has an inlet and an outlet. An entrance fluid retention area is provided adjacent the inlet and an exit fluid retention area is provided adjacent the outlet. At least one fluid balancing channel is provided which extends between said entrance fluid retention area and said exit fluid retention area.

DETAILED DESCRIPTION OF THE INVENTION

Figure 1:
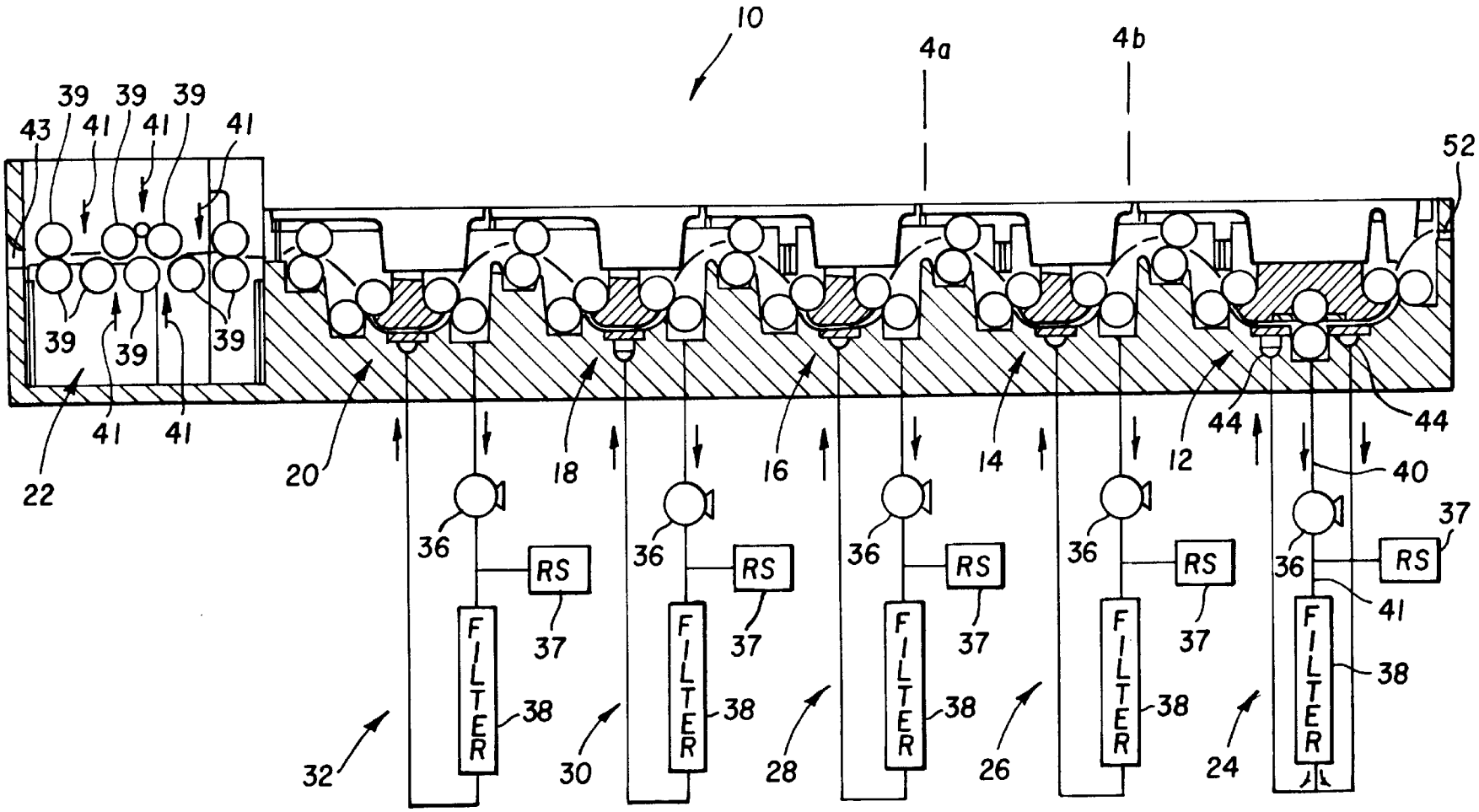
FIG. 1 illustrates a schematic view of a processing apparatus made in accordance with the present invention.

Referring to FIG. 1, there is illustrated a processing apparatus 10 made in accordance with the present invention. The apparatus includes a plurality of processing sections 12,14,16,18,20, each processing section being designed to hold a processing solution 21 for processing a photosensitive material 23 (see FIG. 2B) passing therethrough. In the particular embodiment illustrated, processing section 12 contains a developing processing solution; section 14 contains a bleach-fixing processing solution; and sections 16,18, 20 each contain a stabilizer wash processing solution. The level of the processing solution for each of the processing sections is indicated by the letter L. A dryer 22 is provided for drying of the photosensitive material 23 after the photosensitive material 23 has exited the last processing section 20.

The dryer 22 includes a plurality of rollers 39 for guiding and transporting of the photosensitive material 23 through the dryer 22. An appropriate mechanism, as is well known in the art, is provided for providing drying air against the photosensitive material 23 (not shown in FIG. 1), as indicated by arrows 41, as it passes through the dryer 22 such that the photosensitive material is substantially dry as it exits the apparatus 10 through exit opening 43.

Recirculation systems 24,26,28,30,32 are provided for recirculating processing solution through each of the processing sections 12,14,16,18,20, respectively. Each of the recirculation systems 24,26,28,30,32 are substantially identical in construction, like numerals indicating like parts and operation. Therefore, only recirculation system 24 will be discussed in detail, it being understood that the remaining recirculation systems are substantially identical in construction and operation.

The recirculation system 24 obtains processing solution from outlet 34 which is fluidly connected to pump 36 by conduit 40. Processing solution is recirculated by pump 36 through a filter 38 through conduit 41. The processing solution leaves filter 38 through conduit 42 and is supplied to the inlet 44 of the processing section 12. A replenishment system 37 is provided for introducing replenishment solution into the recirculation system 24 as is commonly done in such processors for replenishment of the recirculating processing solution.

Figure 2A:
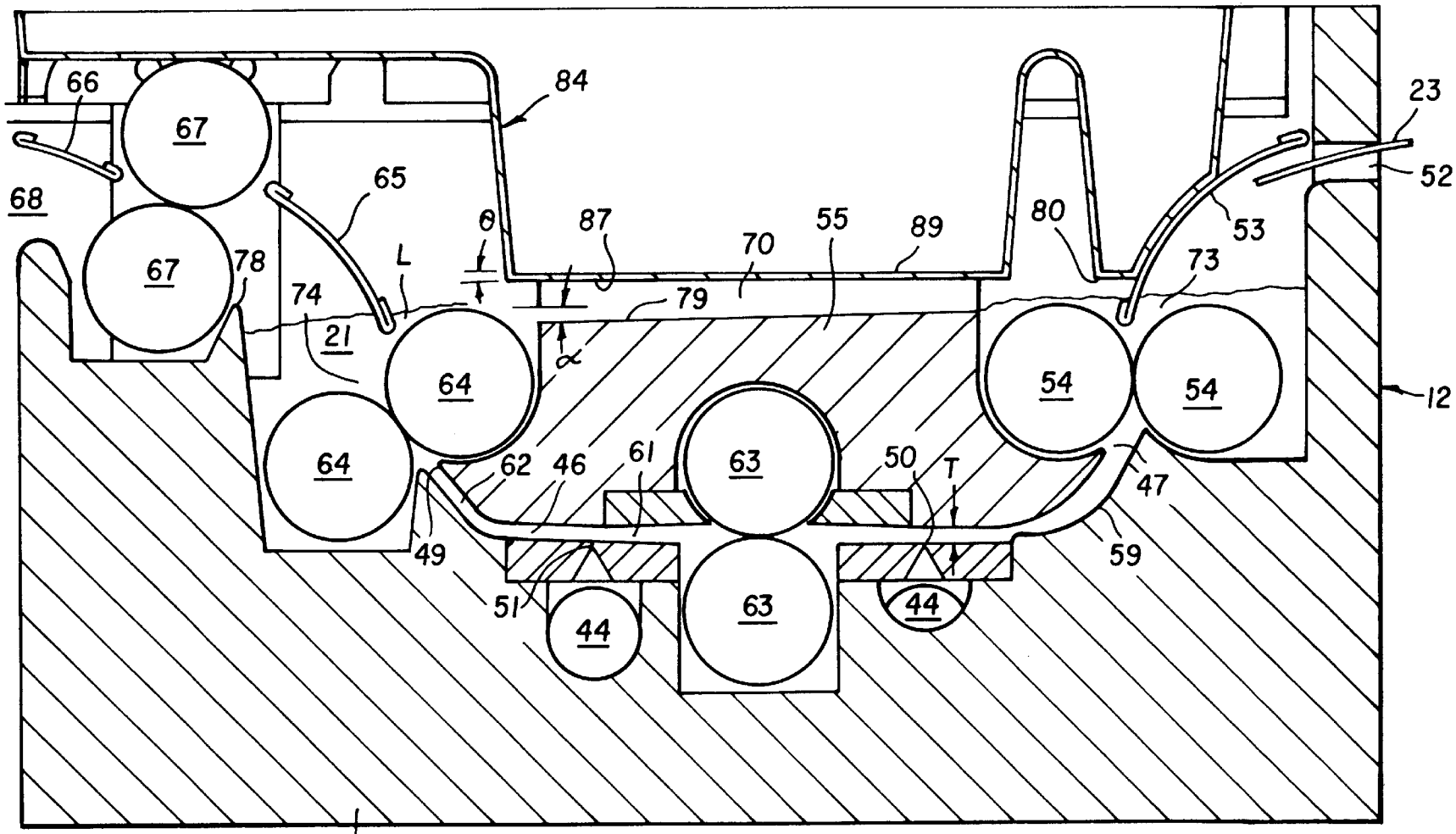
FIG. 2A is an enlarged cross-sectional view of the developing section of the processing apparatus of FIG. 1.

Referring to FIG. 2A, there is illustrated an enlarged view of the processing section 12. The processing section 12 is designed to be of the low volume thin tank type. In particular, a narrow processing channel 46 is provided having an inlet 47 and outlet 49 through which the photosensitive material 23 passes for processing. The processing channel 46 has a substantially constant thickness T along its length. The processing channel 46, for a processor for processing photographic paper, preferably has a thickness T equal to or less than 50 times the paper thickness, preferably a thickness T equal to or less than about 10 times the thickness of the photographic paper. In a processor for processing photographic film, the thickness T should be equal to or less than about 100 times the thickness of the film, preferably equal to or less than about 18 times the thickness of the film.

The processing section 12, as previously discussed, is of the low volume type, that is, the total amount of processed solution contained in the processing section 12 accounts for at least 40% of the total volume of the processing solution available, that is, the processing solution available in the processing section 12 and the recirculation system 24. Preferably, the volume of the processing solution in processing section 12 is at least 50% of the total volume of available processing solution. In the particular embodiment illustrated, the volume of the processing solution in the processing section 12 is approximately 60% of the total volume of processing solution available. The processing section 12 is designed such that there is very little excess area or volume in which the processing solution 21 may reside outside of the processing channel 46. Where possible, the appropriate parts are configured to closely conform to any rollers or other items placed therein.

In the embodiment illustrated, processing section 12 includes a pair of nozzles 50,51 for introducing processing solution 21 from inlet 44 into the processing channel 46 against the side of the photosensitive material 23 having the photosensitive emulsion. The processing solution 21 is introduced so as to impinge against the photosensitive material 23, preferably with a sufficient degree of force so as introduce fresh processing solution to the surface of the photosensitive material 23. In particular, each of the processing nozzles 50,51 comprise an elongated narrow continuous slot which extends across the width of the processing material passing through the processing channel 46.

In order to provide efficient flow of processing solution through the nozzles 50,51, it is desirable for each of the nozzles 50,51 to deliver processing solution through the processing channel 46 in accordance with the following relationship:

$$1 \leq F/A \leq 40$$

wherein:

F is the flow rate of the solution through the nozzle in gallons per minute; and A is the cross-sectional area of the nozzle provided in square inches.

Providing the slot nozzles in accordance with the foregoing relationship assures appropriate discharge of processed solution against the photosensitive material.

Photosensitive material 23 enters the processing section 12 through opening 52 and is guided by guide plate 53 to a pair of entrance rollers 54.

As can be seen, the processing channel 46 has a generally U-shaped overall configuration wherein photosensitive material enters a first generally arcuate section 59 through inlet 47 and then passed through a generally straight section 61 where the nozzles 50,51 are located, and then through a generally arcuate exit section 62 wherein the photosensitive material 23 passes out of the outlet 49 of the processing channel 46. A second, third, and fourth pair of guide/transport rollers 63,64,67 are provided for guiding and/or transporting of the photosensitive material 23. In particular, the pair of rollers 63 guide the photosensitive material 23 in the straight section 61 of the processing channel 46, and rollers 64,67 guide the photosensitive material 23 as it passes outlet 49 of the processing channel 46 and out of processing section 12. A guide plate 66 is provided for guiding of the photosensitive material 23 out of outlet 68 of the processing section 12 onto the next processing section, which in the present embodiment is processing section 14.

As illustrated by FIG. 2A, the processing channel 46 is formed by the shape and positioning of lower block member 48 and upper block member 55. The nozzles 50,51, in the embodiment illustrated, are incorporated into the lower block member 48. As previously discussed, the processing section 12 is designed to hold a minimal amount of processing solution 21. The shape of the block members 48,55 are such that an entrance fluid retention area 73 is provided adjacent the inlet 47 of the processing channel 46 and a fluid retention area 74 is formed adjacent the outlet 49 of processing channel 46. A weir 78 is provided for allowing excess processing solution to pass out the processing section 12. In particular, the weir 78 is disposed for direct fluid communication with fluid retention area 74.

Figure 3:
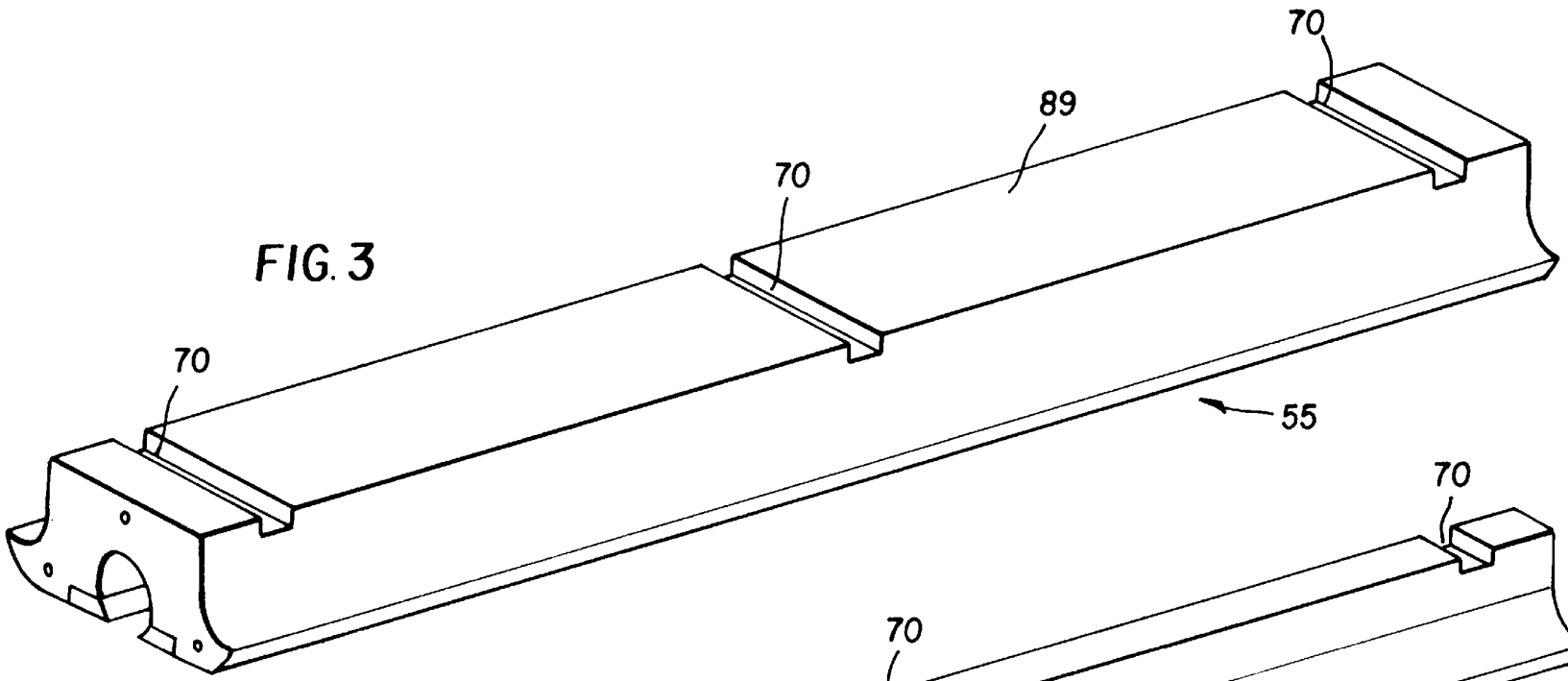
FIG. 3 is a perspective view of the upper block member incorporating the balancing channels made in accordance with the present invention.

Referring to FIG. 3, there is illustrated in perspective view the upper block member 55. The upper block member 55 has formed therein a plurality of balancing passageways/channels 70 which provide fluid communication between the entrance fluid retention area 73 containing rollers 54 of the processing section 12 to the outlet fluid retention area 74 of the processing section containing roller 64. In the embodiment illustrated, three channels 70 are provided, each having a generally rectangular cross-sectional configuration for ease of manufacture. However, any desired number of channels 70 may be provided and have any desired cross-sectional configuration. The channels 70 each have height H and a width W. Volume of the channels 70 is designed so as to minimize the amount of processing solution yet be of sufficient size so as to allow proper flow between the retention areas 73,74. Applicants have found that three channels, each having a height H of about 0.25 inches and a width W of about 0.5 inches, provides adequate flow of processing between the two retention areas.

As illustrated in FIG. 2A, a cover 84 is provided with a surface 87 which is designed to engage the upper surface 89 of the block member 48 and the adjacent processing solution 21 when it rises to the level of the cover 84. The cover 84 assists in minimizing oxidation of the processing solution 21 and protects the processing solution from external contamination and evaporation.

Figure 2B:
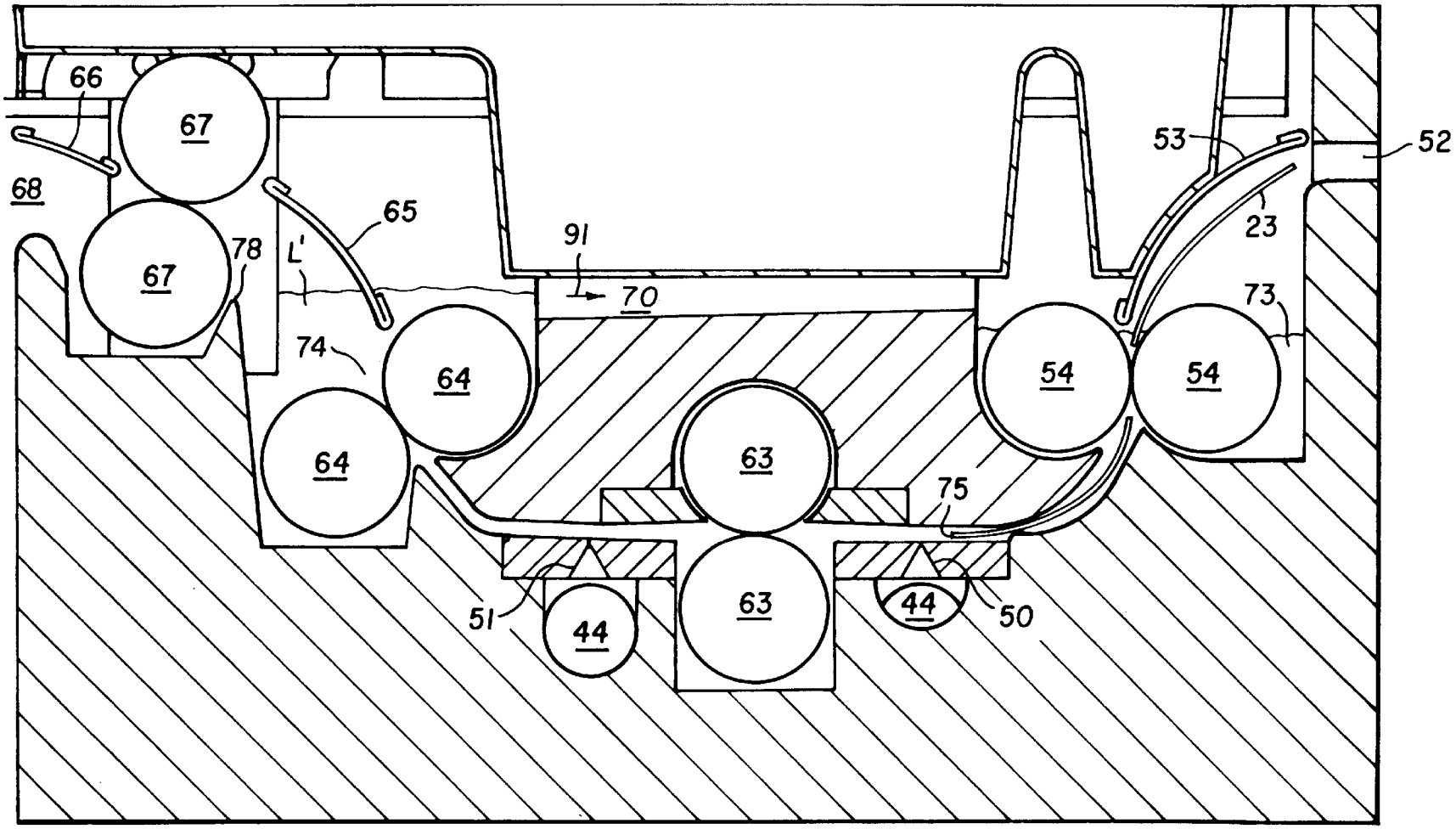
FIG. 2B is a view similar to FIG. 2A illustrating a photosensitive material entering the processing channel prior to reaching the nozzles used to introduce processing solution into the processing channel.
Figure 2C:
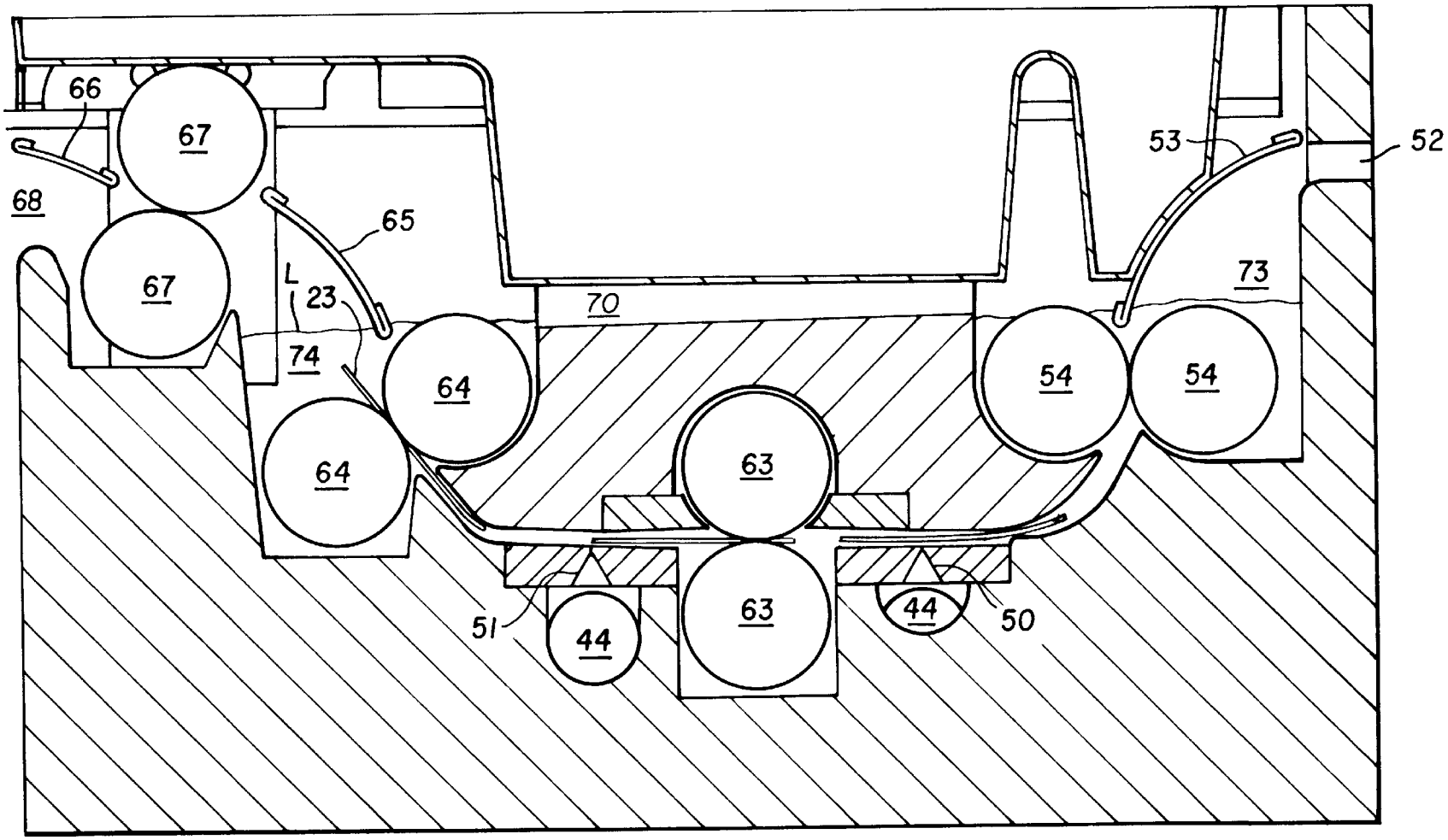
FIG. 2C is a view similar to FIG. 2B illustrating photosensitive material as it passes the nozzles.
Figure 2D:
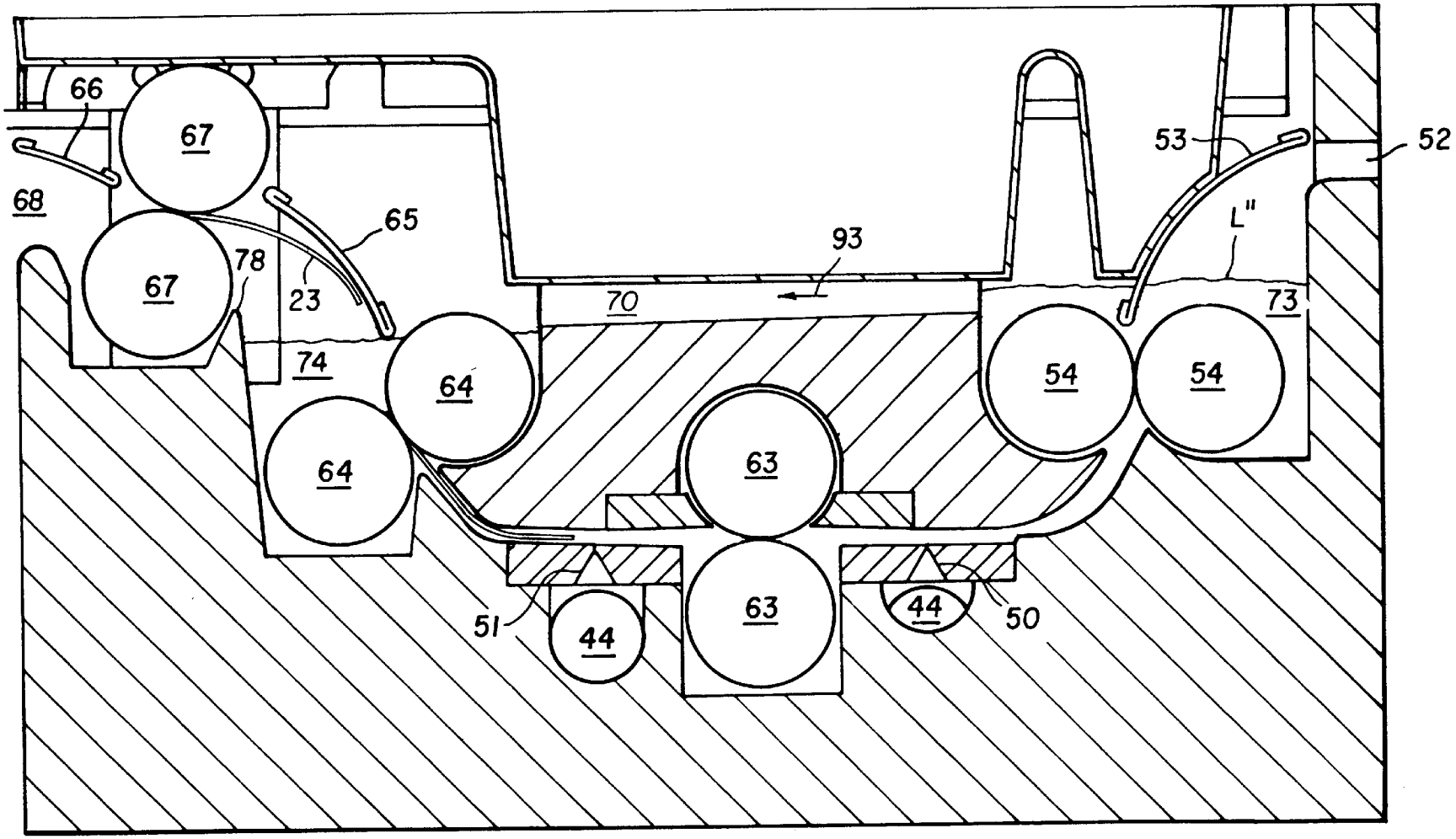
FIG. 2D is a view similar to FIG. 2B illustrating the photosensitive material having just passed the nozzles.

Referring to FIGS. 2B, 2C, and 2D, there is illustrated the progressive positions of a sheet of photosensitive material 23 as it passes through processing channel 46 of processing section 12. In particular, referring to FIG. 2B, a sheet of photosensitive material is illustrated in the position just prior to passing by the first nozzle 50. At this point, excess processing solution 23 will build up in front of the leading edge 75 of the photosensitive material 23 causing the processing solution to flow toward outlet fluid retention area 74. This will cause the processing solution to rise to level L'. The channels 70 limit the amount the processing that may rise within the processing module 12. The processing solution goes from exit fluid retention area 74, as indicated by arrow 91, to entrance fluid retention area 73, thereby increasing the level of the processing solution in the entrance fluid retention area 73 to match the level in exit fluid retention area 74. However, as can be seen, the processing solution 21 still remains below the top of weir 78 and outlet 68, thus avoiding premature disposal of processing solution due to a temporary rise in the processing solution in exit fluid retention area 74.

As the photosensitive material 23 passes over both nozzles 50,51, as illustrated in FIG. 2C, the processing solution returns to initial level L. As the photosensitive material passes past the nozzles 50,51, as illustrated in FIG. 2D, excess processing solution 23 will be forced into entrance fluid retention area 73, however, in this situation due to the balancing channels 70, processing solution 21 will flow from entrance fluid retention area 73 to exit fluid retention area 74, as indicated by arrow 93, thereby balancing the amount of overall processing solution 21 in the processing section 12 such that the processing solution 21 will not rise above the top weir 78 or opening 52 due to the wave effect created by the photosensitive material passing past the nozzles.

Thus, it can be seen that just prior to the photosensitive material passing by the nozzles, processing solution is moving in the direction from the exit area 74 to the entrance area 73, whereas later on when the photosensitive material has passed the nozzles, processing solution 21 flows from the entrance area 73 to the exit area 74, thereby providing internal fluid balancing of the processing solution 21, thereby avoiding any unnecessary loss of processing solution due to the momentary increase in processing solution in one of the fluid retention areas 73,74. The processing channels also prevent vortexing of processing solution resulting from the processing solution dropping too low on one side of the processing channels 46. The recirculation system 24 continuously recirculates processing solution through the processing section 12. If the processing solution drops too low, it may be possible to create vortexing in the side having too little processing solution. This can create a situation where the processing solution overflows out of the processing section causing evacuation of most of the processing solution in the processing channel.

The bottom surface 79 of each of the balancing channels 70 is preferably inclined at a small angle ($\alpha$ with respect to the horizon so that fluid in the channels 70 will drain into one or both of the fluid retention areas 73,74. In the embodiment illustrated the channels 70 is inclined so that the processing solution 21 drains into retention area 74. Preferably, angle $\alpha$ is equal to or greater than 1°, and in the embodiment illustrated $\alpha$ is 2°. However, angle $\alpha$ may be any angle desired as long as it drains the processing solution from the channels 70.

In the embodiment illustrated, the bottom surface 80 of cover 84 over the channels 70 is also canted an angle $\theta$ so as to prevent air from being trapped within channels 70.

Figure 4:
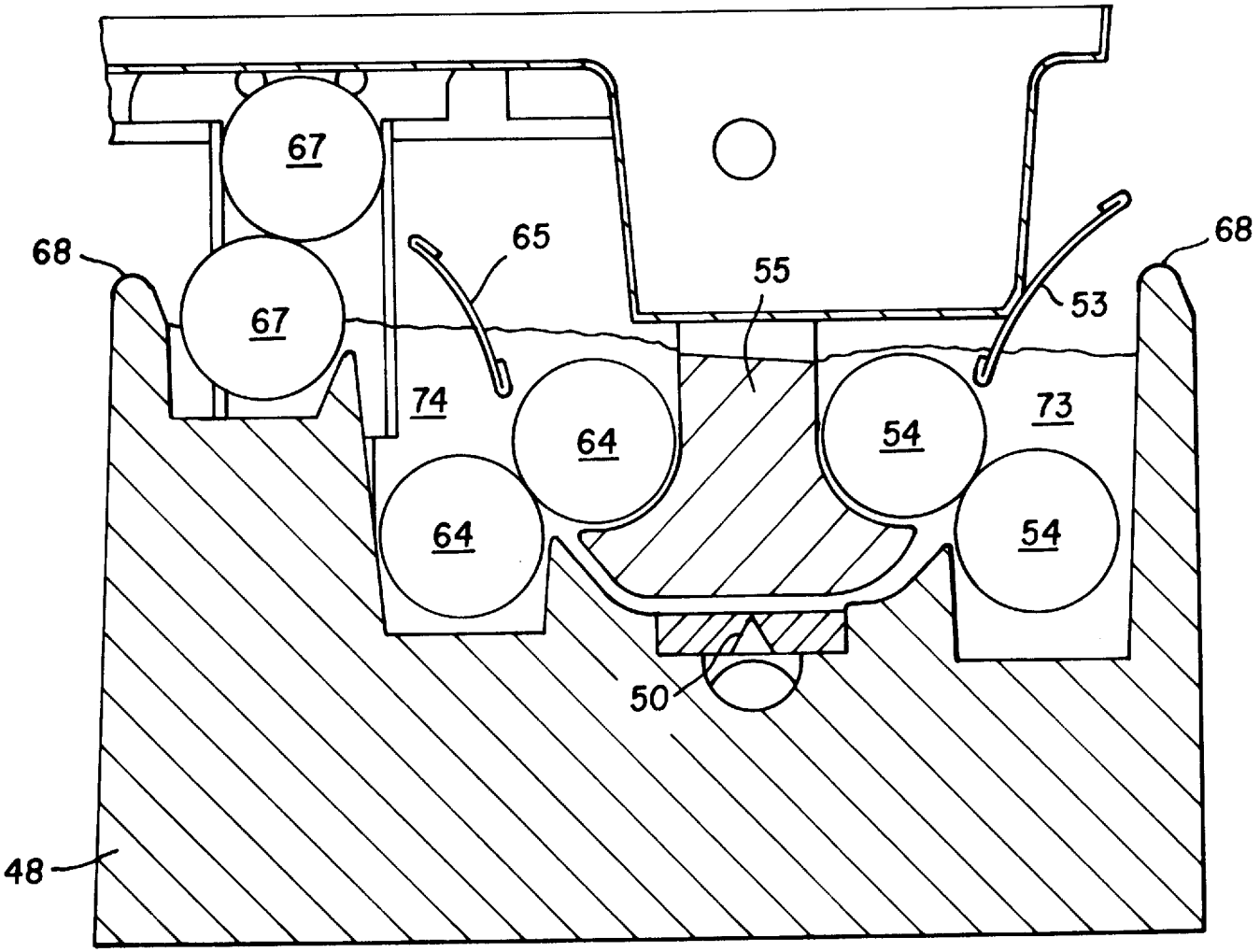
FIG. 4 illustrates an enlarged cross-sectional view of another one of the processing sections of FIG. 1 as taken between lines 4*a*–4*b*.

In the particular embodiment illustrated, processing section 12 includes a pair of nozzles 50,51. However, the present invention is equally applicable to other situations having any desired number of nozzles. Referring to FIG. 4, there is illustrated cross-sectional view of processing section 14. This is similar to processing section 12, like numerals indicating like parts and operation. However, the only distinguishing feature in this embodiment is that instead of providing a pair of nozzles 50,51 only a single nozzle 50 is provided.

Figure 5:
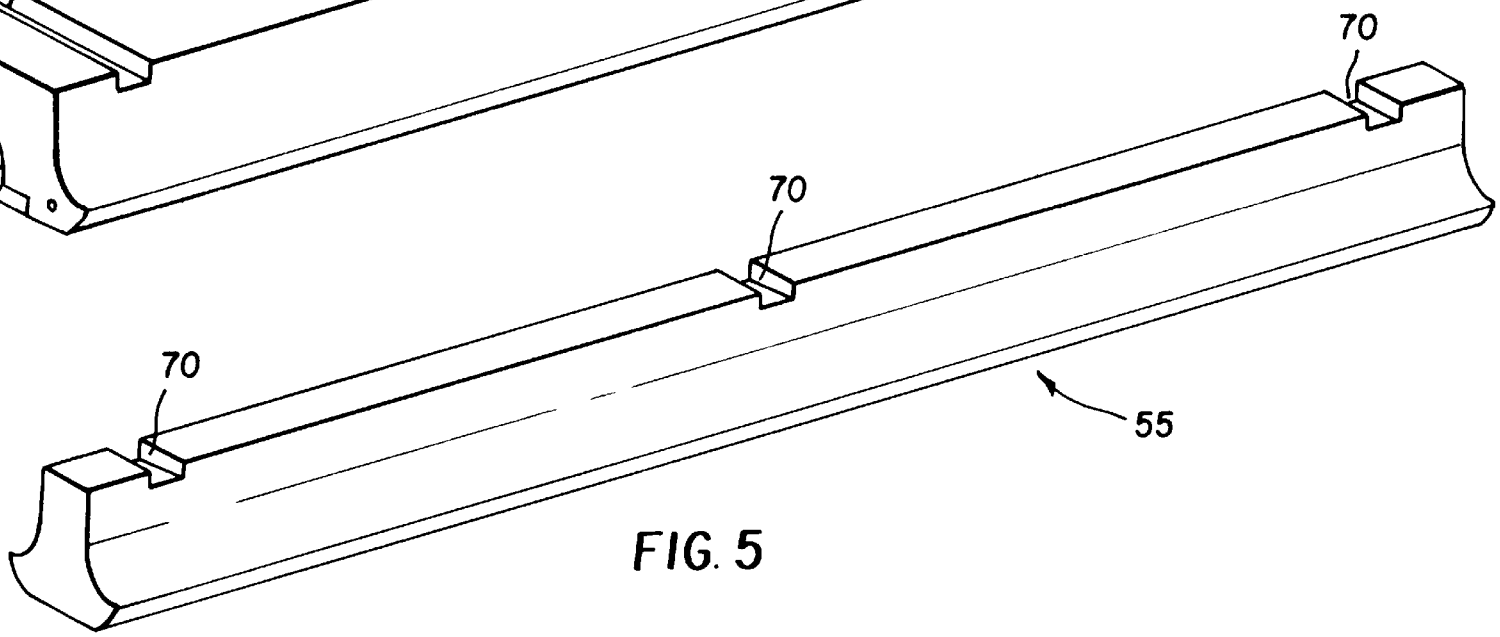
FIG. 5 is a perspective view of the upper block member of the processing section of FIG. 4 illustrating balancing channels made in accordance with the present invention.

Referring to FIG. 5, there is illustrated upper block member 55 having a plurality of balancing channels 70. The basic difference between the block member of FIG. 5 as opposed to that of FIG. 3 is its size. In this embodiment, the use of a pair of rollers 63 for driving of the photosensitive material 23 in central area of the processing channel 46 is no longer necessary. However, the processing channel 46 operates in much the same manner as previously discussed with respect to section 12.

After the photosensitive material 23 has passed through each of the processing channels of the processing sections 12,14,16,18,20, it passes into dryer section 22. Rollers 82 are used to drive the photosensitive material 23 through outlet 86. Arrows 88 indicate flow of heated air, which are used to dry the photosensitive material such that it is sufficiently dry as it leaves the processor 10.

In the preferred embodiment illustrated, the channels 70 are formed on the top of upper block member 55, however, the present invention is not so limited. If desired, the channels 70 may formed within the upper block member 55 or lower block member 48, in which case, the channels/passages should be situated such that the ends of the channels are not blocked by any of the other components of the processor so that free flow of processing solution will occur between the retention areas 73,74 when photosensitive material is being processed.

Thus the present invention provides a low volume processing apparatus having a narrow processing channel for processing a photosensitive material which minimizes potential waste of processing solution due to the processing material passing through the narrow processing channel.

It is to be understood that various other changes and modifications may be made without departing from the scope of the present invention, the present invention being limited by the following claims.

PARTS LIST

10 processing apparatus
12,14,16,18,20 processing sections
21 processing solution
22 dryer
23 photosensitive material
24,26,28,30,32 recirculation systems
34 outlet
36 pump
37 replenishment system
38 filter
39 rollers
40,42 conduits
41 arrows
43 exit opening

44 inlet
46 processing channel
47 inlet
48 lower block member
49 outlet
50,51 nozzles
52 opening
53 guide plate
54 entrance rollers
55 upper block member
59 first generally arcuate section
61 generally straight section
62 generally arcuate exit section
63,64,67 guide/transport rollers
66 guide plate
68 outlet
70 balancing passageways/channels
73 entrance fluid retention area
74 outlet fluid retention area
75 leading edge
78 weir
79,80 bottom surface
82 rollers
84 cover
86 outlet
87 surface
88,91,93 arrows
89 upper surface

What is claimed is:

1. An apparatus for processing a photosensitive material, the apparatus comprising:

a narrow processing channel for holding a processing solution for processing of a photosensitive material, said processing channel having an inlet and an outlet, an entrance fluid retention area is provided adjacent the inlet and an exit fluid retention area is provided adjacent the outlet;

a fluid balancing channel is provided which extends between said entrance fluid retention area and said exit fluid retention area.

2. An apparatus according to claim 1 wherein a fluid nozzle is provided for introducing processing solution into said channel against said photosensitive material.

3. An apparatus according to claim 1 wherein said photosensitive material is photographic paper and said processing channel has a thickness equal to or less than 100 times the thickness of the photosensitive material passing through the processing channel.

4. An apparatus according to claim 1 wherein said photosensitive material is photographic film and said processing channel has a thickness equal to or less than 50 times the thickness of the photosensitive material passing through the processing channel.

5. An apparatus according to claim 1 wherein said photographic material is photographic paper and said processing channel has a thickness equal to or less than 10 times the thickness of the photosensitive material passing through the processing channel.

6. An apparatus according to claim 1 wherein said photographic material is photographic film and said processing channel has a thickness equal to or less than 20 times the thickness of the photosensitive material passing through the processing channel.

7. An apparatus according to claim 1 wherein said balancing channel has a bottom surface which is inclined such that processing solution drains from the balancing channel.

8. An apparatus according to claim 1 wherein said processing channel is formed by an upper block member and a lower block member, said balancing channels being formed on the top of said upper block member.

9. An apparatus according to claim 8 wherein a cover is provided which mates with the top of said upper block member, said cover in the area of said channels being canted so that trapped air within said channels can escape.

10. An apparatus according to claim 1 wherein said channel is provided internally of said upper block member or said lower block member.

11. An apparatus for processing a photosensitive material, the apparatus having at least one processing section, said at least one processing section comprising:

an upper block member;

a lower block member, said upper and lower block member being shaped and positioned with respect to each other so as to form a narrow processing channel for holding a processing solution for processing of a photosensitive material, said processing channel having an inlet and an outlet, an entrance fluid retention area is provided adjacent the inlet and an exit fluid retention area is provided adjacent the outlet;

a nozzle is provided for introducing processing solution into said narrow processing channel; and a fluid balancing channel is provided which extends between said entrance fluid retention area and said exit fluid retention area.

12. An apparatus according to claim 11 wherein said processing channel has a first arcuate section wherein said photosensitive material enters said narrow processing channel, a substantially straight section adjacent the first arcuate section, and a second arcuate section adjacent straight section where said photosensitive material leaves said narrow processing channel, said nozzle being positioned for introducing said processing solution into said straight section.

13. An apparatus according to claim 11 wherein said photosensitive material is photographic paper and said processing channel has a thickness equal to or less than 100 times the thickness of the photosensitive material passing through the processing channel.

14. An apparatus according to claim 11 wherein said photosensitive material is photographic film and said processing channel has a thickness equal to or less than 50 times the thickness of the photosensitive material passing through the processing channel.

15. An apparatus according to claim 11 wherein said photographic material is photographic paper and said processing channel has a thickness equal to or less than 10 times the thickness of the photosensitive material passing through the processing channel.

16. An apparatus according to claim 11 wherein said photographic material is photographic film and said processing channel has a thickness equal to or less than 20 times the thickness of the photosensitive material passing through the processing channel.

17. An apparatus according to claim 11 wherein said balancing channel has a bottom surface which is inclined such that processing solution drains from the balancing channel.

18. An apparatus according to claim 11 wherein a cover is provided which mates with the top of said upper block member, said cover in the area of said channels being canted so that trapped air within said channels can escape.

19. An apparatus according to claim 11 wherein said channel is provided internally of said upper block member or said lower block member.

20. An apparatus according to claim 11 wherein a plurality of balancing channels are provided.

21. An apparatus according to claim 20 wherein three balancing channels are provided.

* * * * *